US005469679A

United States Patent [19]

Burkard et al.

[11] Patent Number: 5,469,679

[45] Date of Patent: Nov. 28, 1995

[54] PROTECTIVE COVER WITH LOCKING COLLAR AND INSTALLATION TOOL

[75] Inventors: Christopher J. Burkard, Austin; Norman G. Manley, Leander, both of Tex.

[73] Assignee: Minnesota Mining and Manufacturing Company, St. Paul, Minn.

[21] Appl. No.: 307,326

[22] Filed: Sep. 16, 1994

[51] Int. Cl.[6] ..... B65D 59/06

[52] U.S. Cl. ..... 52/301; 52/98; 52/244; 52/677; 52/DIG. 12; 81/44; 138/96 R

[58] Field of Search ..... 52/244, 301, DIG. 12, 52/98, 677, 749, 741.3; 138/96 R.96 T; 81/44, 487

[56] References Cited

U.S. PATENT DOCUMENTS

| | | | |
|---|---|---|---|
| 2,385,055 | 9/1945 | Breslove | 138/96 R |
| 3,587,654 | 6/1971 | Yocum . | |
| 4,014,368 | 3/1977 | Nelsen . | |
| 4,158,407 | 6/1979 | Rest | 138/96 R |
| 4,184,516 | 1/1980 | Oesterritter et al. . | |
| 4,202,378 | 5/1980 | Hams . | |
| 4,269,232 | 5/1981 | Witschi . | |
| 4,809,752 | 3/1989 | Strodter . | |
| 4,833,850 | 5/1989 | Lunn . | |
| 4,957,141 | 9/1990 | Dreyfuss et al. . | |
| 5,004,016 | 4/1991 | Kliewer . | |
| 5,161,581 | 11/1992 | Scheetz . | |

*Primary Examiner*—Carl D. Friedman
*Assistant Examiner*—Christopher Todd Kent
*Attorney, Agent, or Firm*—Gary L. Griswold; Walter N. Kirn; David W. Anderson

[57] ABSTRACT

Protective, sealing cover made of flexible material for easy application over an exposed end of a cut reinforcing bar. The cover contains a water impermeable sealant which surrounds the end of the cut bar during the process of applying the cover. A dual function tool facilitates the process of cover application by first positioning the cover then setting a locking means to secure the cover to the bar.

17 Claims, 3 Drawing Sheets

PROTECTIVE COVER WITH LOCKING COLLAR AND INSTALLATION TOOL

BACKGROUND OF THE INVENTION

1. Field of the Invention

The invention relates to corrosion and safety protection of networks of steel bars used to reinforce concrete or similar structures. In one aspect, the invention provides a protective end cover which also acts as a seal to prevent moisture from attacking and corroding the exposed ends of coated reinforcing bars. A locking mechanism cooperates with the cover to hold it securely in position on the steel bar. An application tool facilitates the attachment and affixing of the protective end cover.

2. Description of the Art

Steel reinforcing bars, organized in a network, according to a pre-determined shape, provide an internal support skeleton for concrete structures. During construction of reinforced concrete structures, such as buildings, concrete pillars, road beds etc., exposed ends of reinforcing bars, also termed "rebars," protrude from the unfilled concrete form at a variety of angles. Such ends are sharp, presenting a hazard to e.g. building-site personnel and others who may inadvertently collide with the exposed projections. Forceful contact with exposed rebar ends results in potentially severe injury.

A further problem with exposed rebar ends is their tendency to provide bare metal surfaces where moisture attacks, in the presence of oxygen, causing the corrosive process of rusting. To overcome rusting of rebar, modern technology commonly employs a surface coating of plastic over the length of the rebar. This prevents access by moisture except at points where the rebar is cut to a prescribed length. Cutting produces rebar ends, exposing bare metal, that corrodes.

The prior art discloses a variety of protective covers or safety caps applied to metal bars, pipes, flanges or fittings. U.S. Pat. Nos. 4,202,378 and 4,833,850 describe removable safety caps which cover the exposed ends of rears to prevent injury. The claimed invention of U.S. Pat. No. 4,561,226 includes a cavity closure cap. This is part of a complex arrangement to provide a grease-filled cavity around the end of a rebar.

Flexible, polymeric caps provide protection for the ends of pipes. Such caps protect pipe features such as threaded end portions which are prepared for subsequent operations. Damage to these special features may destroy their function. U.S. Pat. Nos. 4,269,232; 4,809,752; 4,957,141; 5,004,016 and 5,161,581 describe pipe thread protectors or caps for pipe ends. Attachment of this type of protective means is generally not permanent. This is especially true of the invention described in U.S. Pat. No. 3,587,654, wherein quick removal of the cap is an important aspect of the invention. Inventions of removable caps, described by U.S. Pat. Nos. 4,014,368 and 4,184,516 respectively, extend the application of these devices to union nuts and pipe flanges.

The prior art does not address corrosion protection or protection retention for exposed ends of rebar. Therefore, the current invention provides protection from injury using a generally cylindrical cover applied to a rebar end. Further, this invention provides environmentally sealed rebar ends as a protection against corrosive agents. This invention also provides protective covers, firmly attached to rebar ends using locking means associated with the protective cover. Thereafter, attempts to remove the cover will cause its destruction or, at least, damage it sufficiently to prevent its re-use.

SUMMARY OF THE INVENTION

The present invention provides an article for covering an end of a metal bar for protecting workers and restricting corrosion. The article comprises a hollow tube having an inner surface, an outer surface and opposite ends. The first of the opposite ends is an open end, the second of the opposite ends is a closed end, having internal and external faces wherein the internal face of the closed end and the inner surface of the hollow tube define the internal volume of an open-ended tubular enclosure. The tube has at least one longitudinal slit extending from the open end, in a wall of the hollow tube. A quantity of sealant is deposited inside the open-ended tubular enclosure adjacent the closed end. A locking means is provided for securing the tube over an end of a metal bar inserted in the tubular enclosure toward the internal face of the closed end. The locking means illustrated is a collar or ring attached to the outer surface by a frangible web which collar can be separated and slide from an intermediate position of the hollow tube toward the open end.

The article may have a flared portion adjacent the open end of the hollow tube, resulting from the slits or an increase in thickness of the walls forming the hollow tube adjacent the open end. Further, the wall may be beveled on the inner surface to increase the size of the throat leading into the hollow tube.

A tool is disclosed to facilitate application of a hollow tube to the metal rod. The tool comprises a tubular housing having proximate and distal ends, with the proximate end being sized to receive a hollow tube to a position in contact with a piston located in the housing adjacent the distal end. In a first orientation of the housing in relationship to the piston, a force, applied to the housing, acts through the piston and against the hollow tube to urge it over the end of a metal bar. In a second orientation of the housing in relationship to the piston, additional force applied to the housing operates on the locking means to move it to a locking position in relationship to the hollow tube, establishing a firm gripping relationship with the metal bar. Means affording selective engagement between the first orientation and the second orientation of the housing and piston are provided.

The method of protecting and/or encapsulating the end of the bar affords an easy and rapid procedure by placing a hollow tube in the tool, positioning it in relationship to the bar end, and forcing it on the bar and locking it in place.

DESCRIPTION OF THE FIGURES

The invention is illustrated in the accompanying drawing wherein.

DETAILED DESCRIPTION OF THE INVENTION

Figure 1:
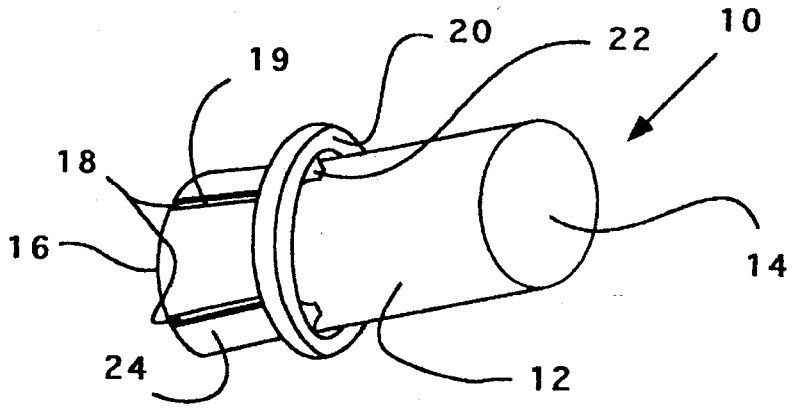
FIG. 1 is a perspective view of a generally cylindrical cover according to the present invention.

The present invention provides protection for metal forms used as internal reinforcement for large objects such as concrete pillars, bridge decks, road beds and the like. Steel bar, usually selected to construct concrete reinforcement, requires protection against corrosion by rusting in the presence of moisture and oxygen. A resin coating applied to the steel provides its primary means of protection. Damage or disruption of the coating occurs in a variety of ways. The coating may puncture, abrade or be intentionally cut to provide a bar of specified length. Cutting a length of bar exposes bare metal over the cross-sectional area of the cut. This area is susceptible to corrosion. Resealing the end of a cut bar returns the bar to a protected condition, free of corrosion. Providing this protection requires a method which is quick, easy and free from cleaning, mixing, or maintenance procedures associated with application and curing of polymeric coatings.

The resealing means of the present invention is an article that covers uncoated ends of metal bars to seal or enclose the ends of the metal bars restricting access by air and moisture.

The article of the present invention reseals the cut ends of steel reinforcing bars, surrounding them with a moisture impermeable, sealant barrier. Thermoplastic polymers are suitable for making the cover, comprising a hollow tubular member and collar. Each of the tubes has an open end and a closed end. The open end incorporates design features to facilitate attachment and retention of the cover over the end of a cut rebar. These design attributes cause the cover diameter to be greater at the open end than at the closed end. Also, it is desirable to have the wall thickness greater at the open end than at the closed end. The wall thickness profile gradually changes, from the open end, in the neck portion of the tube which represents about one third the length of the tube. The wall thickness decreases in the neck portion from the open end toward the collar, after which it is uniform to the closed end of the cover. Viewed externally, the cover appears flared towards its open end. The inside surface of the cover is less flared than the outside surface. However, internal flaring is sufficient to accommodate any deformity in the rebar end that occurred during the rebar cutting process. This internal flaring acts as a guide for correct seating of the rebar inside the cap. As it penetrates the cap, the rebar makes contact with the protective sealant. Sealant material will cover the end and flows around and along a length of bar which is inserted into the cylindrical reservoir. The steel bar reaches the limit of insertion when it makes contact with the closed end of the enclosure. With no further action, removal of the cylindrical cover readily occurs. To prevent undesirable, inadvertent removal of the cover a locking mechanism affixes it to the end of the exposed steel bar. A suitable locking mechanism is a molded-in-place, friction-fit, preferably frangibly attached, collar or ring which encircles the outer surface of the cylindrical tube, spaced initially from its open end.

Before inserting the bar into the-open end of the cover, the collar or ring occupies a position between the open end and the central portion of the cylindrical cover. Means for securing the collar to the outer surface of the cylindrical cover include frangible elements such as ties, tethers or a continuous circumferential, frangible membrane. With the bar fully inserted in the cover, application of suitable force to the collar causes the frangible element to break allowing the collar to slide along the neck portion towards the open end of the cover. The force to move the collar increases as this locking mechanism reaches the slightly flared neck portion of the cylindrical cover.

Gripping action of the cylindrical tube increases by the placement of several longitudinal slits in the wall of the neck portion of the cylinder extending from the open end of the cover. In its final position the advancing edge of the locking collar is close to the open end of cover. A positive way to set the collar in its final locked position and not move off the tube, is to place a lip or flange about the end portions of the cover at its open end. These lips will stop the locking collar's movement beyond the open end of the tube.

An installation tool may be used to apply the covers of the present invention to rebar ends and set the locking mechanism in the optimum position for the cover to exert maximum gripping action to the surface of the rebar.

Referring now to the drawing, FIG. 1 illustrates the rebar protective cover 10 of the present invention. The cover 10 comprises a generally cylindrical hollow tube 12, which has a closed end 14 and an open end 16. The open end 16 may be flared, whereby its diameter is greater than the diameter of the closed end 14 of the hollow tube 12. A number of slits 18, formed in the wall of the hollow tube 12, extend from the open end 16 longitudinally in the neck of the hollow tube 12 towards its closed end 14. The slits 18 have parallel, opposed walls 19 which may separate to allow flexure and easy insertion of rebar into the cover 10. A locking mechanism 20 in the form of a ring or collar 20 attaches to the outer surface of the hollow tube 12 by at least one frangible element or web 22. Application of sufficient force causes the frangible element 22 to break allowing the collar to slide toward the open end 16. The locking mechanism 20 encircles the hollow tube 12. The internal diameter of the collar 20 is less than the diameter for the outer surface of the open end 16 of the hollow tube 12, when the open end 16 extends from a flared neck portion 24 of the tube 12. Otherwise, the internal radius of the collar 20 is slightly larger than the radius of the outer surface of the hollow tube 12. Further detail of the flared end portion of tube 12 appears in FIGS. 3, 6 and 7 where gradual thickening of the wall 19 extends approximately from the point of attachment of the frangible element 22 to the open end 16 of the tube 12. The linear portion of the wall 19, of increasing thickness is also referred to as the neck portion 24 of the cover 10. A mold, designed to produce a cover 10, by one of a number of well-known molding techniques, will have provision to produce optional combinations of attributes. While retaining a generally cylindrical form the mold may provide variation in the internal diameter of the tube 12 along its length. Similarly the external diameter of the tube 12 may vary linearly so that desirable thickening of the wall 19 in the neck portion 24 is achieved. Thereby, both the internal and external profile of the tube will appear flared. However, flaring of the outer surface of the tube 12 will generally be more pronounced than the inner surface. This design attribute ensures development of a firm gripping action by the cover 10 to the rebar during activation and positioning of the locking mechanism 20. The activation process causes the frangible element 22 to break, releasing the collar which slides towards the open end 16 of the tube 12. Other features may be molded at the open end 16 of the hollow tube 12. For instance a lip 32 (see FIG. 3) prevents the collar 20 from slipping over the open end of the tube. The bevelled edge 34 in FIG. 3*a* facilitates insertion of an exposed rebar end into the cover 10.

Figure 2:
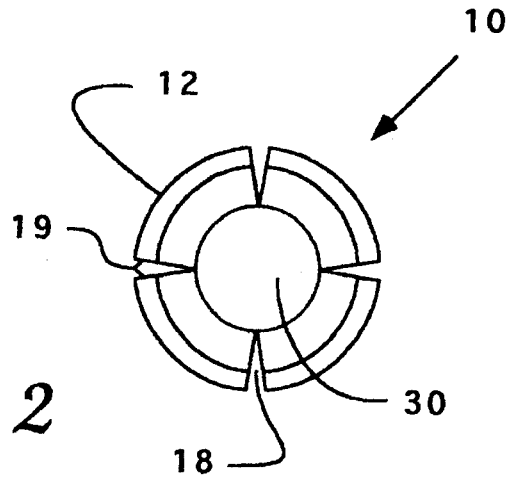
FIG. 2 is an end view from the open end of the cover.
Figure 3:
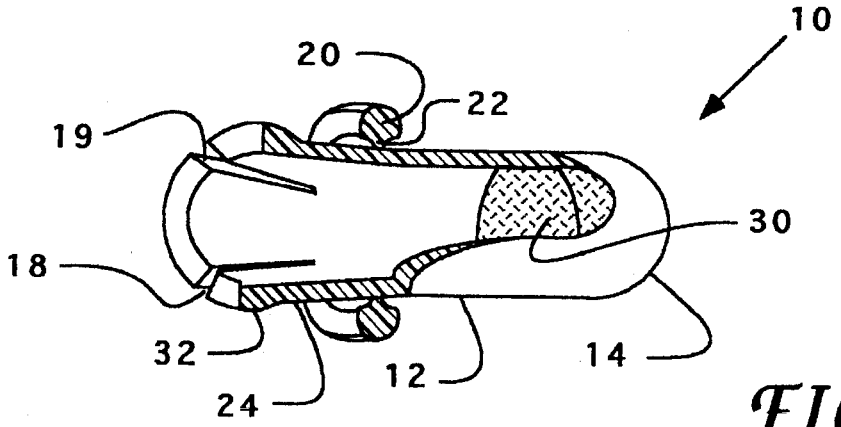
FIG. 3 is a detail view with a portion of the cover cut away to reveal a quantity of sealant.
Figure 3A:
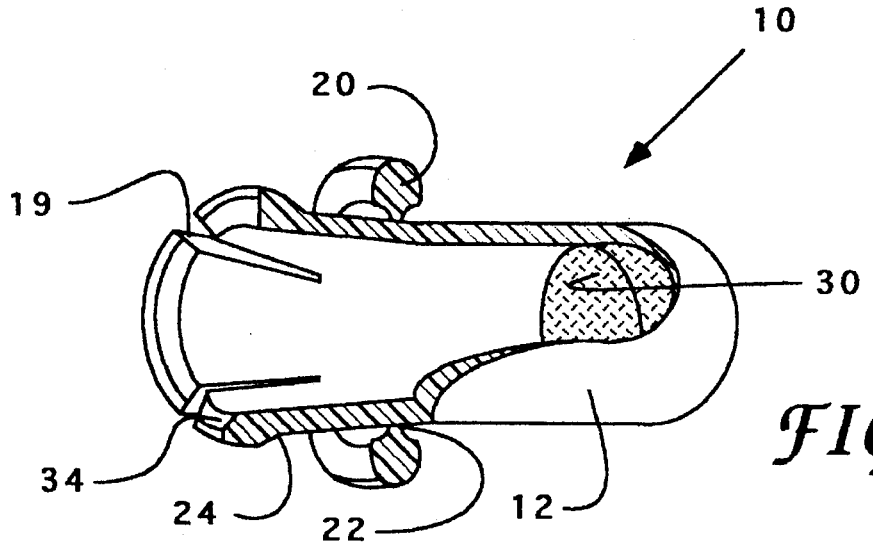
FIG. 3*a* is a detail view showing a bevelled entry portion at the open end of the cover.

FIGS. 2 and 3 show a mass of sealant 30 positioned inside the hollow tube 12 of the cylindrical cover 10 adjacent to the closed end 14 of the hollow tube. The fluid sealant 30 under normal conditions of use has a viscosity in the range 300,000 to 350,000 cps (Brookfield viscosity measured at 10 rpm and 25° C.) so that it will not flow out of the hollow tube 12. It is, however, capable of flowing around a steel bar 40, shown in FIG. 4, as it is moved adjacent to the closed end 14 of the cylindrical cover 10 as illustrated. The sealant should be chemical and corrosion resistant, such as a lubricant, and having a cone penetration of about 300 to 350 at 25° C. Preferably, the sealant is LUBRIZOL 2358™ available from Lubrizol Corporation of Wickliffe, Ohio.

Figure 4:
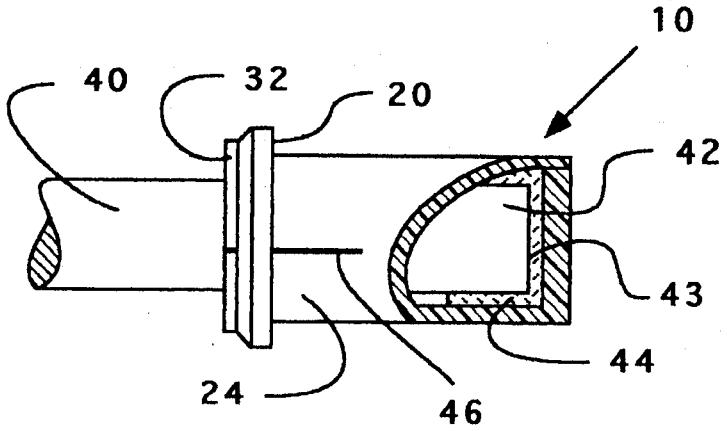
FIG. 4 is a plan view of the cylindrical cover locked in position over the end of a metal bar.

FIG. 4 illustrates the result of inserting a steel bar 40 into the cylindrical cover 10 and locking the cover on the end 42 of the steel bar 40. In this position the end 42 of the steel bar 40 has penetrated the sealant mass 30 forcing it to flow along the sides of the bar to cover the surface of the bar adjacent the exposed end 43. This forms a sealant coating 44 around the end 42 of the steel bar 40. With the steel bar 40 fully inserted into the hollow tube 12, force is applied to the locking mechanism 20. This breaks the frangible element 22 allowing the locking mechanism 20 to slide towards the open end 16 and lip 32. Motion of the locking mechanism towards the open end 16 squeezes the sections in the neck portion 24, of the cover 10, against the surface of the rebar exerting a firm gripping action around the rebar 40. The slits 18 become narrower as gripping action increases until, in its final position, the collar 20 forces opposing walls 19 to closely approach each other to form closed slits 46. The open end 16 closes around the rebar 40 as the closed slits 46 form. As the open end 16 closes, the inner surface of the neck portion of the hollow tube 12 exerts a gripping action on the steel bar 40 causing firm attachment of the cylindrical cover 10.

Figure 5:
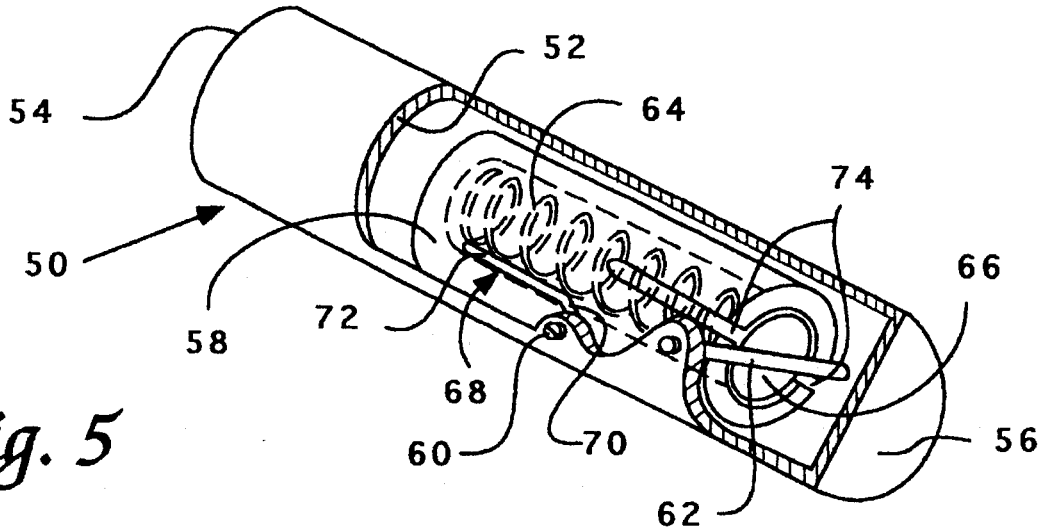
FIG. 5 is a detail view of the installation tool with part of the housing cut away to reveal detail of the internal mechanism.

Application and locking of the cover 10 over the rebar 40 may be completed manually. It is, however, much more convenient to apply the cover 10 using the specially designed installation tool shown in FIG. 5. The installation tool 50 comprises a tubular housing 52 having an open end 54 and a closed end 56. A piston 58 fits inside the tubular housing 52 with the closed head of the piston 58 facing the open end 54 of the tubular housing 52. A set screw 60 and a thrust rod 62 combine to restrict the movement of the piston 58 inside the tubular housing 52. The set screw 60, as illustrated, screws into the housing wall and penetrates the inside cavity while the thrust rod 62 lies diametrically in the cavity of the tubular housing 52. Each end of the thrust rod 62 fits in a receiving hole in the housing wall without protruding from the outer surface of the housing. A tight frictional fit for the thrust rod ends in the holes in the housing wall, results from careful sizing of the receiving holes.

The position of the thrust rod 62 from the closed end 56 of the housing 52 and several features associated with the piston 58 assure successful repeated application of covers 10 to the ends 42 of rebars 40. A bore, machined in the base of the piston 58, accommodates a helical compression spring 64. The spring receives the stem of a circular bolt 66, maintaining the flat end portion of the bolt head in a slightly extended position relative to the plane of the base of the piston 58. In the assembled installation tool 50, the base of the piston 58 and the flat end portion of the bolt 66 rest against the side of the thrust rod 62 farthest from the closed end 56 of the tubular housing 52, preferably, and illustrated as cylindrical. This places the spring 64 under slight compression that could lift the base of the piston 58 from the side of the thrust rod 62 and force the piston 58 outward of the cavity against the set screw 60. The set screw 60 fits in a groove 68 cut in the outer surface of the piston 58 when the set screw 60 is correctly adjusted. The groove 68 has a step portion 70, adjacent the base or end of the piston having the bore, and a longitudinal or axially extending channel portion 72. The spring 64 forces the piston 58 in a direction to hold the end of step portion 70 against the set screw 60. Clockwise rotation of the housing 52 relative to piston 58 and the travel of each depends on the height and angle of the step 70 in relationship to the channel portion 72. The step design also controls alignment, or misalignment, of the thrust rod 62 with two diametrically opposed slots 74 formed in the wall of the base of the piston 58. When alignment occurs, force may be applied to the housing 52 whereby the set screw 60 moves along the longitudinal channel 72 and the thrust rod 62 enters the slots 74 in the piston 58. Thus the housing 52 may move over the piston 58 reducing the distance between the base of the piston 58 and the closed end 56 of the housing 52. Movement of the housing 52 ceases when the set screw 60 traverses the full length of the longitudinal channel 72, or the thrust rod reached the end of the slots 74, or alternatively the base of the piston 58 hits the closed end of the housing 52. Compression of the spring 64 increases, with this movement, as the thrust rod 62 travels into the slots 74. With the force removed, the compressed spring returns the housing 52 to its starting position relative to the piston 58. As the spring 64 pushes the piston away from the thrust rod 62 and the thrust rod out of the slots 74, the set screw 60 re-traces its path along the longitudinal channel 72 of the groove 68. When the thrust rod 62 emerges from the slots 74, the set screw 60 re-enters the step portion 70 of the groove 68. Residual compression in the spring 64 causes the set screw 60 to follow the angle of the step 70, rotating the piston 58 clockwise relative to the housing 52. This resets the thrust rod 62 out of alignment with the piston slots 74. In this condition the installation tool 50 is set to begin the process of applying a cover 10 to the next rebar 40. Further detail of cover application is provided with reference to FIGS. 5, 6 and 7.

Figure 6:
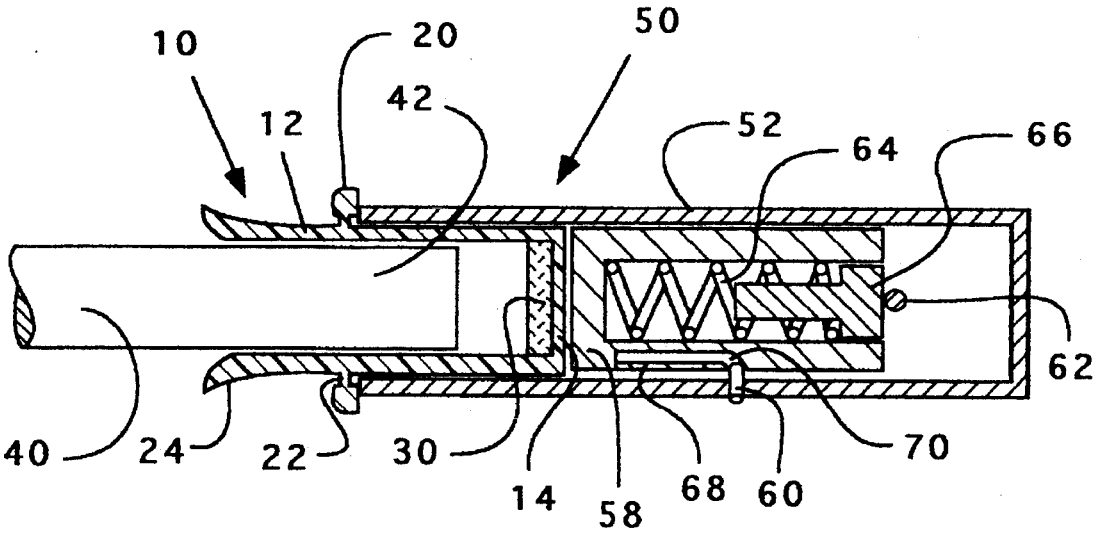
FIG. 6 is a cross-sectional view of the cylindrical cover, inserted in the installation tool, before actuating the locking collar.

FIG. 6 shows installation tool 50 into which a cover 10 has been inserted until the outer surface of the closed end 14 of the cover 10 makes contact with the top of the piston 58. Cover 10, shown in its preferred form, has no lip, is flared adjacent the open end 16 and increases in wall thickness in the neck portion 24. A rebar 40 may be partially inserted into the cover 10, as illustrated in FIG. 6, by placing the end of the rebar in the open end 16 of the cap and applying axial pressure to the tubular housing 52 of the installation tool 50 to cause the cover 10 to move along the length of the rebar 40. The force, applied to the housing 52 acts through the thrust rod 62 against the base of the piston 58 and is transmitted to the closed end 14 of the hollow tube 12. This urges the hollow tube 12 along the rebar 40. As the hollow tube 12 of the cover 10 moves along the rebar 40, the rebar end 42 makes contact with the mass of grease 30 causing it to flow around the rebar end 42. Grease displacement continues until the rebar end 42 is seated against the closed end 14 of the cover 10. At this point the hollow tube 12 is fully applied to the rebar end 42 and now needs to be locked in position. This is done by applying a clockwise rotational force to the tubular housing 52. The rotation moves the set screw 60 clear of the step portion 70 of the groove 68, into the longitudinal channel 72, aligning the thrust rod 62 with the slots 74 in the base of the piston 58. Thereafter, the application of axial force on the housing 52 moves the housing along the hollow tube 12, the set screw 60 along the longitudinal channel 72 and the thrust rod 62 into the slots 74. In its progress along the hollow tube 12, the wall forming the leading edge at the open end 54 of the housing 52 makes contact with the trailing face of the locking collar 20. Application of more force breaks the frangible element 22 allowing the locking collar to slide, ahead of the housing, to close the open end 16 of the hollow tube 12 about the rebar 40. This initiates contact between the surface of the steel bar 40 and the inner surface of the neck portion 24 of the hollow tube 12.

Figure 7:
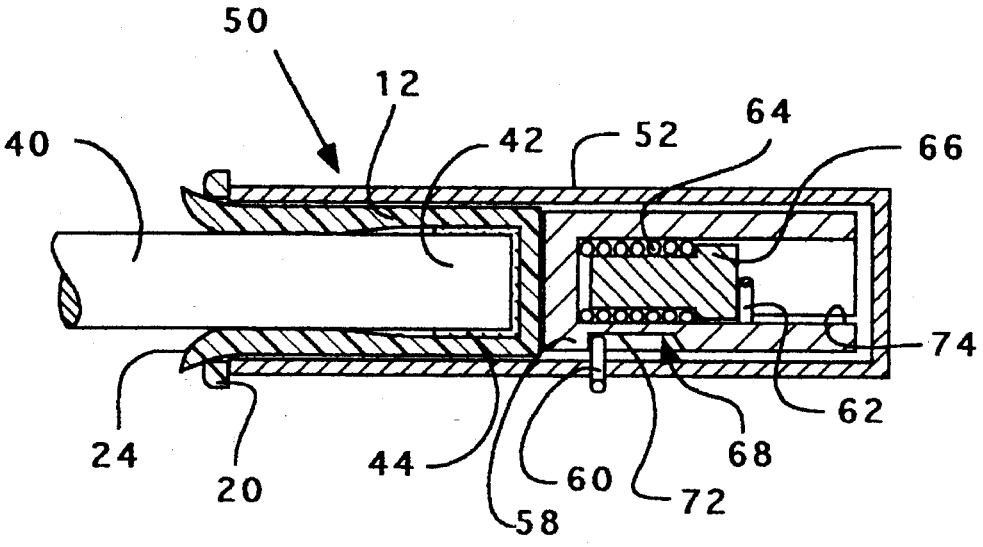
FIG. 7 is a cross-sectional view of the cylindrical cover, inserted in the installation tool, with the locking collar positioned for firm attachment of the cover to the end of the rebar.

The position, just described, is shown in FIG. 7 wherein the tubular housing 52 has traversed the full length of the protective cover 10 to position the locking collar and establish a gripping, sealing relationship between the surface of the rebar 40 and the inner surface of the neck portion 24 of the hollow tube 12, and the tube is held in position by the frictional force between the collar 20 and the outer surface of the hollow tube 12. The installation tool 50 may now be extracted from the installed cover 10 allowing repositioning of the piston by recovery of the spring as previously described.

Articles of the invention may be molded, for example, by injection molding using flexible, thermoplastic resins such as polyolefins. Preferably protective covers of the invention are made of polyolefin resins such as low density polyethylene and polypropylene.

In operation the end of a length of epoxy coated rebar was cut to expose a fresh surface of metal. Epoxy coated rebar of the type used for concrete reinforcement is suitable for test purposes. The test sample was about 30.0 cm long and approximately 1.25 cm in diameter.

Installation of a cylindrical cover of the invention was initiated by inserting the freshly cut end of the test sample rebar in the open end of the cover. Movement of the bar into the cover continued until the end of the rebar made contact with the closed end of the cover. As the rebar moved down the length of the tube it compressed the sealant, forcing it to coat the cut end and adjacent outer surface of the rebar. The sealant, surrounding the end of the rebar, formed a thin, protective layer separating the surface of the rebar from the internal wall of the cover. Sufficient sealant was included inside the cover to completely surround the freshly cut end and extend its protection to a portion of the inserted length of the rebar. Variations in rebar cross-section are accommodated by flexure of the material used to fabricate the cover, entry features at the throat of the hollow tube 12 such as a bevelled edge 34 at its open end and slits 18 cut in the neck portion of the tube to allow its deflection.

Firm attachment of the cylindrical cover, to the inserted bar, occurs by activating the locking collar mechanism positioned around the cover. The collar, before activating, is attached to the outer surface of the cylindrical cover by at least one frangible element which ruptures under axial pressure applied by the collar installation tool. Internally, the diameter of the tool must be large enough to receive the hollow tube but not large enough to accommodate the locking collar.

The installation tool was positioned over the cover in contact with the locking collar. Force, exerted to break the frangible element, moved the collar towards the neck of the cylindrical tube. Positioning of the collar also closed the wall slits in the neck of the cylindrical cover and caused the cover to grip the circumference of the steel bar. It was not possible to dislodge the cylindrical cover from the rebar sample.

The sample, prepared as described, was tested using ASTM D3963-A.1.4.2. This test involved the formation of an electrolytic cell with the sample as one of the electrodes. The end of the sample, protected by the cylindrical cover, was submerged in a 7% sodium chloride solution so that the cover was below the surface of the electrolyte. At the end of one month the sample showed no evidence of corrosion on the bare end of the steel bar, inside the cover. This indicated that no electrolyte was able to reach the exposed surface of the bar. Also, due to the epoxy coating insulating the surface of the bar, no degradation of the steel bar occurred even though it was connected as the anode during periodic cycling of positive and negative connections. The connections were alternated for periods up to one week. Extended testing showed that the cylindrical cover provides long-lasting protection for the exposed ends of metal bars used for reinforcement.

Having disclosed the present invention with respect to the presently preferred embodiments, it will be appreciated that changes may be made without departing from the spirit or scope of the invention as defined in the appended claims.

What is claimed is,

1. An article for covering an end of a metal bar comprising, a hollow tube having an inner surface, an outer surface and opposite ends, the first of said opposite ends being an open end, the second of said opposite ends is a closed end having internal and external faces wherein said internal face of said closed end and said inner surface of said hollow tube define the internal volume of an open-ended tubular enclosure, said hollow tube having at least one longitudinal slit adjacent said open end, in a wall of said hollow tube, a quantity of sealant inside said open-ended hollow tube, and locking means for securing said hollow tube over a said end of a metal bar inserted in said tubular enclosure toward said internal face of said closed end.

2. An article according to claim 1 wherein said wall of said tube comprises a flared portion adjacent said open end of said hollow tube and said wall of said tube increases in thickness adjacent said open end.

3. An article according to claim 1 wherein said inner surface of said hollow tube, at said open end is bevelled forming a funnel-shaped entrance into said tubular enclosure.

4. An article according to claim 1 further comprising a lip extending radially outwardly of said outer surface of said wall at said open end.

5. An article according to claim 1 wherein said locking means is held by attachment to said outer surface of said hollow tube.

6. An article according to claim 5 wherein said locking means is attached to said tube by a frangible element selected from ties, tethers, or membranes.

7. An article according to claim 2 wherein said locking means comprises a locking ring having internal and external surfaces such that the diameter of said internal surface is greater than the diameter of said outer surface of said hollow tube, but less than the diameter of said outer surface of said hollow tube at said flared portion.

8. An article according to claim 1 wherein said tube is formed of a thermoplastic resin.

9. An article according to claim 8 wherein said thermoplastic resin is a polyolefin polymer selected from the group consisting of polyolefin homopolymers, polyolefin copolymers and blends of polyolefin polymers.

10. An article according to claim 8 wherein said thermoplastic resin is a polyolefin polymer selected from the group consisting of polyethylene and polypropylene.

11. An article according to claim 1 wherein said quantity of sealant comprises a water insoluble, chemical and corrosion resistant grease having a cone penetration of from about 300 to about 350 at 25° C.

12. A tool to facilitate application of a hollow tube, having associated locking means, around the end of a metal bar and thereafter activating the locking means to firmly attach the tube to the bar comprising, a tubular housing having proximate and distal ends, said proximate end being sized to receive a said hollow tube in said housing in contact with a piston, in said housing, located adjacent said distal end, said proximate end being capable of interacting with said locking means, a first orientation of said housing in relationship to said piston whereby force, applied to said housing, acts through said piston against said hollow tube to urge said hollow tube over said end of said metal bar, a second orientation of said housing in relationship to said piston whereby force applied to said housing operates on said locking means moving said locking means relative to said tube, until said tube establishes a firm gripping relationship with said metal bar and means for selective engagement between said first orientation and said second orientation.

13. A tool according to claim 12 wherein, said tubular housing, is defined by a wall having an interior surface and an exterior surface, said housing further comprising, a thrust rod, having opposing rod ends, said ends being secured diametrically inside said tubular housing adjacent said distal end, said thrust rod axis lying in a plane at right angles to the longitudinal axis of said housing, a threaded set screw penetrating said wall of said tubular housing, said set screw extending beyond said interior surface, said piston placed inside said tubular housing, having a groove formed in the peripheral surface, said groove having a step portion connecting with a longitudinal channel portion, said groove being aligned to receive said set screw, said piston further comprising, a closed head portion opposite a base portion and having an internal bore opening toward said base portion, said base portion having two diametrically opposed slots extending longitudinally towards said closed head and communicating with said bore, a spring contact member having a flat-end portion supporting a compression spring and located in said bore formed in said piston, said spring providing means for urging said flat-end portion outward of said piston, wherein said base of said piston and flat-end portion are in contact with said thrust rod, said piston having a first position with said slots misaligned with said thrust rod, when said set screw is in said step portion, and a second position with said slots aligned to receive said thrust rod when said piston and said tubular housing are rotated to position said set screw in said channel portion.

14. A method for protecting the end of a metal bar comprising the steps of, a) inserting a hollow tube into a tool having a tubular housing, b) positioning said end of a said metal bar to be received in said hollow tube, c) applying axial pressure to said housing to urge said hollow tube on to said metal bar, d) adjusting said housing to facilitate engagement with a locking means and e) applying force to said housing to set said locking means relative to said hollow tube which thereby exerts a firm gripping action on said metal bar.

15. A method according to claim 14 wherein said axial pressure is transferred by said housing to a thrust rod secured diametrically inside said housing, said thrust rod acting against the base of a piston, said piston disposed in a first orientation relative to said housing, said piston further transmitting said axial pressure to said hollow tube.

16. A method according to claim 15 wherein said adjusting of said housing establishes a second orientation of said piston relative to said housing causing alignment of said thrust rod with diametrically opposed slots in said base of said piston, said thrust rod entering said slots and said housing engaging said locking means.

17. A method according to claim 16 wherein said force displaces said locking means by disrupting means for holding said locking means outside said hollow tube, said force then advancing said housing and said locking means over said hollow tube towards said metal rod, in which direction said hollow tube increases in circumference causing said locking means, being a circumferential collar of fixed diameter, to apply squeezing pressure to said hollow tube, said squeezing pressure producing said firm gripping action between said hollow tube and said metal bar.

* * * * *